US005292046A

United States Patent [19]

Kaiser et al.

[11] Patent Number: 5,292,046

[45] Date of Patent: Mar. 8, 1994

[54] ROLL FILM DISPENSER

[75] Inventors: Ian R. Kaiser, Encinitas; Michael C. Kaiser, Malibu; Sean A. Neiberger, La Costa, all of Calif.

[73] Assignee: Allen Reed Company, Incorporated, Los Angeles, Calif.

[21] Appl. No.: 980,456

[22] Filed: Nov. 23, 1992

[51] Int. Cl.[5] ..... B26F 3/02

[52] U.S. Cl. ..... 225/19; 225/39; 225/43; 225/46; 225/89

[58] Field of Search ..... 225/39, 43, 46, 47, 225/89, 19, 77; 206/409, 411, 373; 190/117, 115

[56] References Cited

U.S. PATENT DOCUMENTS

| | | | |
|---|---|---|---|
| 2,305,592 | 12/1942 | Anderson | 225/77 X |
| 3,034,690 | 5/1962 | Klun | 225/19 |
| 3,144,970 | 8/1964 | Beschmann | 225/39 |
| 3,391,765 | 7/1968 | Baker | 190/117 |
| 3,567,087 | 3/1971 | Schramm | 225/43 |
| 3,688,625 | 9/1972 | Thomas et al. | 83/614 |
| 3,851,809 | 12/1974 | McKibbin | 225/20 |
| 3,974,947 | 8/1976 | Budny | 225/25 |
| 3,989,175 | 11/1976 | Cherrin | 225/46 X |
| 4,059,210 | 11/1977 | Deering, Jr. | 225/47 |
| 4,119,251 | 10/1978 | Golner et al. | 225/20 |
| 4,156,382 | 5/1979 | Baker | 93/33 |
| 4,170,914 | 10/1979 | Carrier | 83/580 |
| 4,196,647 | 4/1980 | Fish | 83/175 |
| 4,197,774 | 4/1980 | Singh et al. | 83/374 |
| 4,210,043 | 7/1980 | Urion et al. | 83/175 |
| 4,245,536 | 1/1981 | Urion | 83/821 |
| 4,325,176 | 4/1982 | Urion et al. | 29/450 |
| 4,417,495 | 11/1983 | Gordon et al. | 83/175 |
| 4,450,996 | 5/1984 | Kamp | 225/43 |
| 4,646,956 | 3/1987 | Ruff et al. | 225/77 |
| 4,648,536 | 3/1987 | Vanderlugt | 225/43 |
| 4,651,911 | 3/1987 | Kirkup et al. | 225/20 |
| 4,666,072 | 5/1987 | McCarter | 225/25 |
| 4,754,674 | 7/1988 | Perlman | 83/422 |
| 4,762,042 | 8/1988 | Denter et al. | 83/374 |
| 4,787,284 | 11/1988 | Chen | 83/614 |
| 4,951,858 | 8/1990 | Krall | 225/19 |
| 4,957,023 | 9/1990 | Chen | 83/372 |
| 4,960,022 | 10/1990 | Chuang | 83/175 |
| 4,967,628 | 11/1990 | Judd et al. | 83/455 |
| 5,025,692 | 6/1991 | Reynolds | 83/468 |
| 5,036,740 | 8/1991 | Tsai | 83/455 |
| 5,044,241 | 9/1991 | Labrecque | 83/489 |

OTHER PUBLICATIONS

Photographs of Reynolds Clik-Cut TM Film Dispenser.

Photographs of Tablecraft Ken-Kut TM Safety Dispenser.

*Primary Examiner*—Eugenia Jones

*Attorney, Agent, or Firm*—D'Alessandro, Frazzini & Ritchie

[57] ABSTRACT

A roll film dispenser is disclosed which utilizes a switch-retractable serrated blade to cut film being dispensed. In one embodiment of the invention, the roll film dispenser contains a roll of film which is arranged so that the end of the roll exits the dispenser through a slot at the top. Severance of the film is accomplished by tearing the sheet over the serrated blade. When not in use, the serrated blade may be manually retracted. Optionally, an acrylic sheet may be interposed between the slot and the blade to aid in stabilizing PVC-type films prior to cutting. A conforming weight is provided at the lower rear of the dispenser to resist rollover.

9 Claims, 4 Drawing Sheets

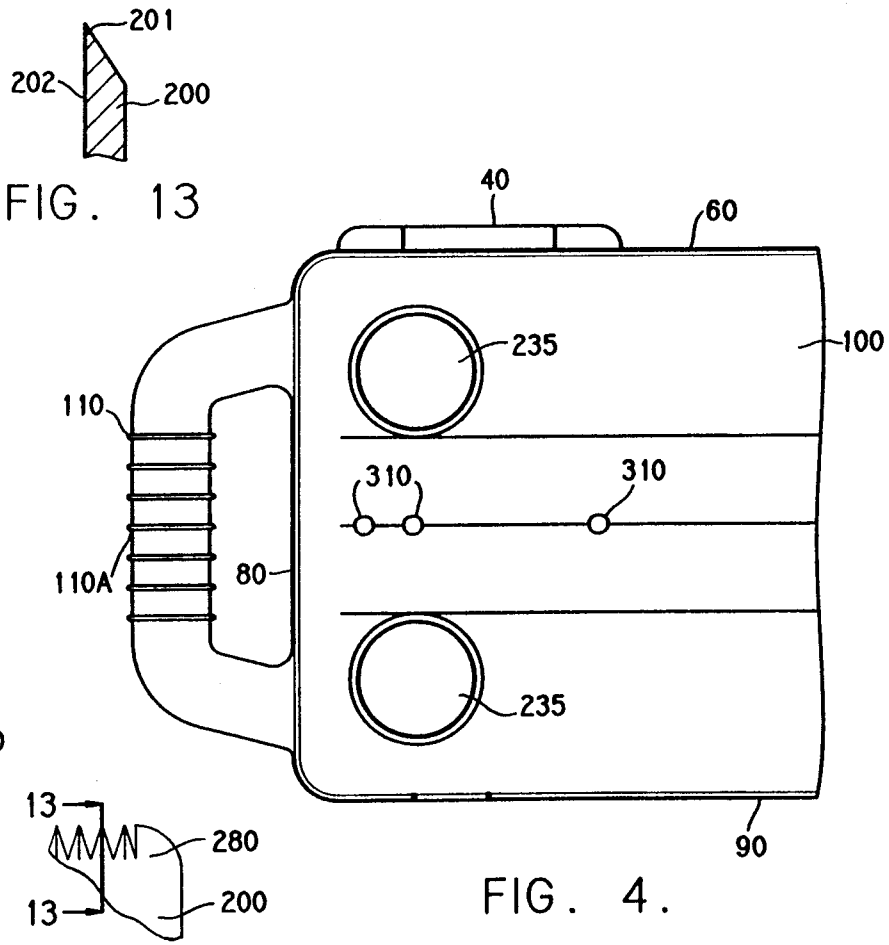
FIG. 13
FIG. 4.
FIG. 12.
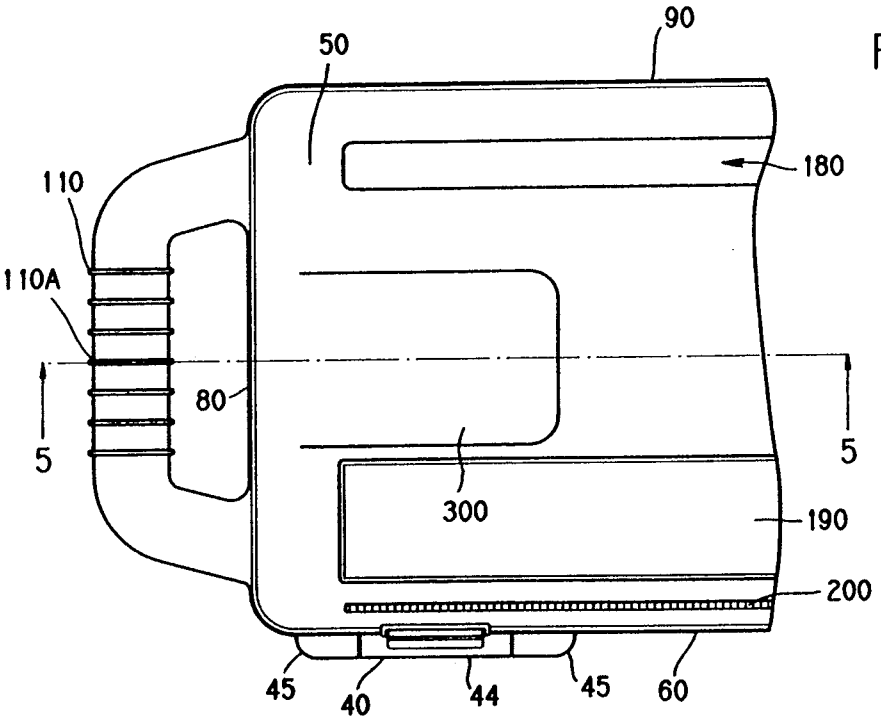
FIG. 3.

ROLL FILM DISPENSER

BACKGROUND OF THE INVENTION

1. Field of the Invention

The field of the present invention relates to the field of roll film dispensers. Roll film dispensers, also known as web dispensers and flexible wrap dispensers, serve to dispense and sever film or web from a roll of the same.

2. Description of the Related Art

A common use for roll film dispensers is for the dispensing and cutting of sheets of PVC film used in the food service industry for covering and sealing dishes and trays of food. Similarly, wax paper, aluminum foil, and flexible wrappings such as gift wrapping paper, butcher paper, wallpaper and the like may also be dispensed by roll film dispensers.

A large number of flexible wrap dispensers are known. Since flexible wrap dispensers are primarily used commercially in restaurants, food service establishments and the like, efficiency and safety are of paramount importance.

Two serious recurring problems in the food service industry are (1) injuries caused to workers from being accidentally cut with or struck with the sharp blades of flexible wrap dispensers, and (2) waste of material due to replacement of a roll of flexible wrap prior to the exhaustion of the roll.

Many known flexible wrap dispensers present a dangerous cutting surface which may pose a risk of serious injury to the user. Some makers of flexible wrap dispensers have attempted to solve the safety problem at the cost of increased complexity. In some cases the increased complexity has made it difficult to use the dispenser.

Typically a flexible wrap dispenser is placed on a flat surface, such as a shelf, and the flexible wrap is pulled out of it and cut. Pulling the wrap creates a tensional force tending to cause the dispenser to roll over and fall toward the person pulling the wrap.

The common 3000 and 5000 foot rolls of PVC used in the food service industry are quite heavy and help to stabilize the flexible wrap dispensers—when they are full. A common problem occurs when the roll of flexible wrap is partially empty. Because a dispenser with a nearly empty supply of flexible wrap is much lighter than one that has a full supply, the former is less stable and may move when the end of the flexible wrap is pulled. If the dispenser is on a shelf, it may fall off. Accordingly, either injuries are risked or the roll is replaced (and thus the original weight and stability restored) at the expense of waste of the remainder of the roll. Neither outcome is desirable.

Another problem is posed by cardboard and paper dispensers. These tend to get wet in the kitchen environment causing structural failure of the dispenser and an early disposal and waste of the remainder of the roll of wrap.

A further problem with prior art dispensers of PVC film is that the film tends to tangle and fold once it has been cut because it is electrostatically attracted to itself. This problem leads to waste of film and frustration on the part of users.

SUMMARY OF THE INVENTION

The present invention is directed to a roll film dispenser. To this end, a roll film dispenser having a hand-operated switch retractable user replaceable serrated blade with a rear cutting surface is provided. The retractable blade has an extended position and a retracted position. In the extended position, the blade is available to cut the film; in the retracted position, it is not.

In accordance with another aspect of the present invention, a strip of acrylic material is optionally interposed between a slot through which the film exits the roll film dispenser and the blade. The strip electrostatically attracts PVC-type films which may be used in roll film dispensers and aids in stabilizing them and preventing tangling and unwanted folding of the film.

In accordance with another aspect of the present invention, a weight is provided for attachment to the rear interior of the roll film dispenser so as to reduce its center of gravity and reduce the tendency of the dispenser to move about or pivot when the film roll is nearly depleted and the film is pulled.

In accordance with another aspect of the present invention, an axle which supports the roll of film within the dispenser is displaced rearward of the geometric center of the dispenser so as to further resist the tendency of the dispenser to move about or pivot forward when the film roll is nearly depleted and the film is pulled from the front.

Accordingly, it is an object of the present invention to provide an improved roll film dispenser. Other and further objects and advantages will appear hereinafter.

BRIEF DESCRIPTION OF THE DRAWINGS

FIG. 3 is a top view of the dispenser;

FIG. 4 is a bottom view of the dispenser;

FIG. 12 is a enlarged view of the dispenser blade taken about section line 12 of FIG. 1;

FIG. 13 is a cross section of the dispenser blade taken along section line 12—12 of FIG. 12.

DESCRIPTION OF THE PREFERRED EMBODIMENTS

The present invention relates to roll film or flexible wrap dispensers. Roll film dispensers hold and dispense film from a roll. Typically, roll film dispensers may be used to dispense PVC film, aluminum foil, wax paper, butcher paper, wrapping paper, other plastic film, gift wrapping paper, wallpaper and the like.

In use, the roll of film has a hollow cylindrical cardboard core which is placed on an axle in the roll film dispenser, the axle is clamped in place, the film is threaded through an exit slot in the top of the dispenser, the roll film dispenser is closed and the film arranged to be cut by a switch retractable serrated blade.

Figure 1:
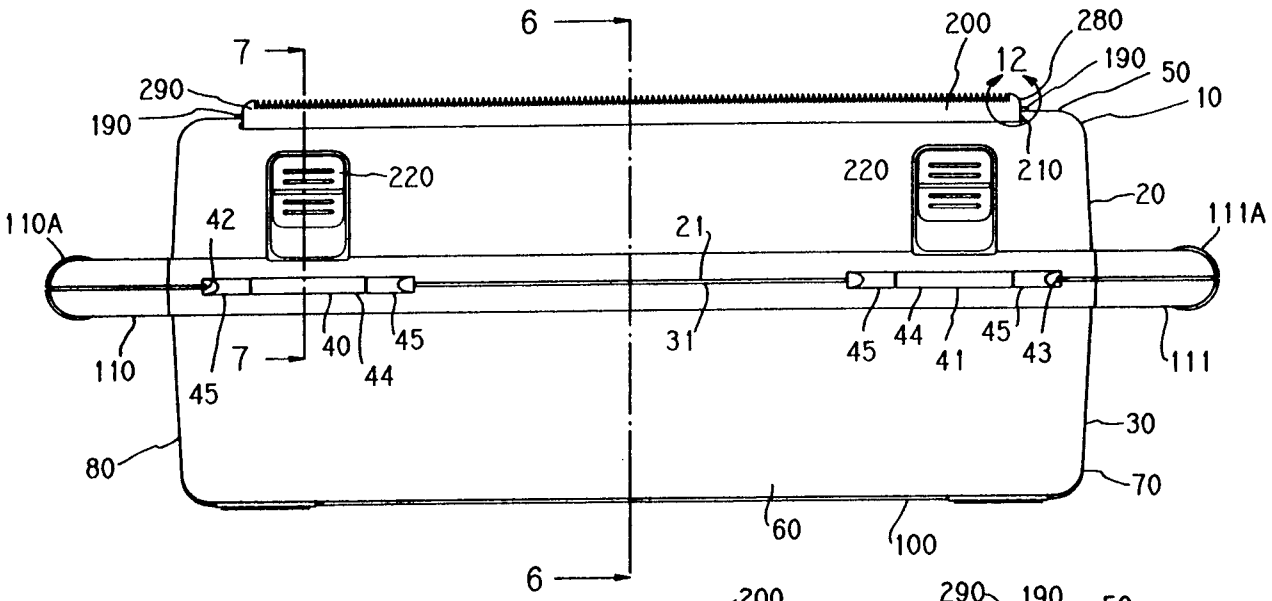
FIG. 1 is a front view of the dispenser.
Figure 2:
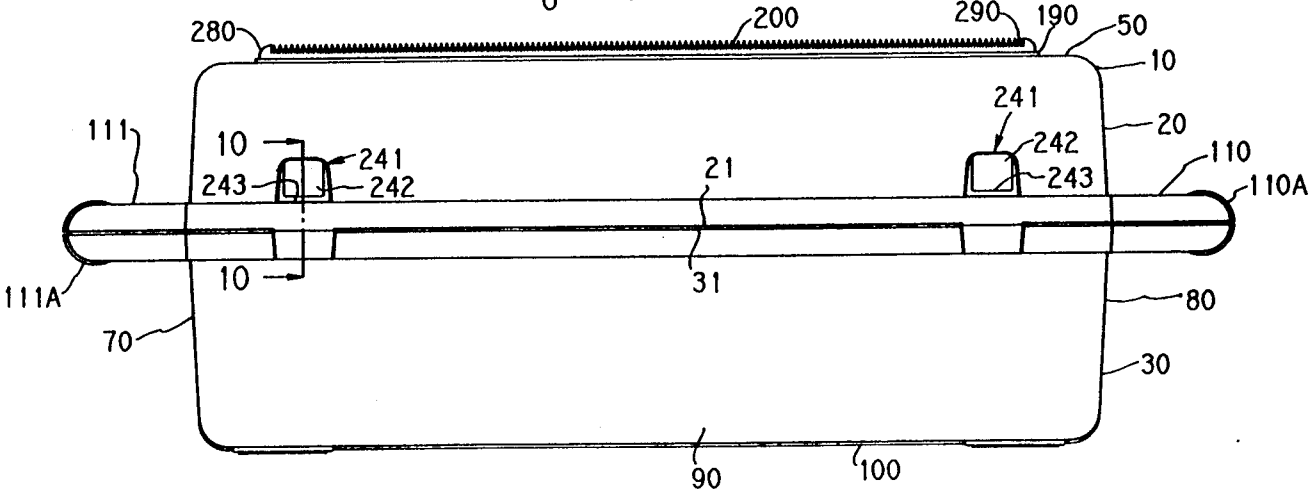
FIG. 2 is a back view of the dispenser.

Turning to the drawings, FIGS. 1 and 2 show the roll film dispenser 10. The roll film dispenser 10 is preferably fabricated of a rough finished ABS plastic for durability and dishwasher cleanability. Other materials could be used as is well known in the art. Dispenser 10 is a container which has an upper portion 20 and a lower portion 30 which are attached at hinges 40, 41. Hinges 40, 41 include a hinge pin (not shown) inserted through hinge pin holes 42, 43 respectively. Each hinge pin hole is preferably sealed with a dab of silicone adhesive (not shown). The dabs of silicone adhesive prevent dirt and bacteria from entering and building up inside hinge pin holes 42 and 43. Hinge pin holes 42, 43 each penetrate longitudinally protruding portions of upper portion 20 (44 in FIG. 3) and lower portion 30 (45 in FIG. 3) in a conventional manner. Dispenser 10 has a top 50, front 60, left side 70, right side 80, rear 90 and bottom 100. Lower portion 30 also has an upper rim 31 which mates with lower rim 21 of upper portion 20. Integral with roll film dispenser 10 are handles 110 and 111 located respectively at the left side 70 and right side 80. The lower portion 30 and upper portion 20 of dispenser 10 are split along handles 110, 111 as shown in, for example, FIG. 5 to form on each side of dispenser 10 a pair of mating "half-handles". In this way, by grasping the handle, one can prevent accidental opening of the dispenser simply by holding upper portion 20 and lower portion 30 together at the handles 110, 111. This feature is particularly useful because it allows dispenser 10 to be held in one hand by handles 111 or 110 and then swung or moved around something on which it is desired to dispense film such as an entire cart of food. Knurling is provided to improve hand-holdability on handle grips 110*a*, 111*a* as shown in FIGS. 1, 2, 3 and 4.

Figure 5:
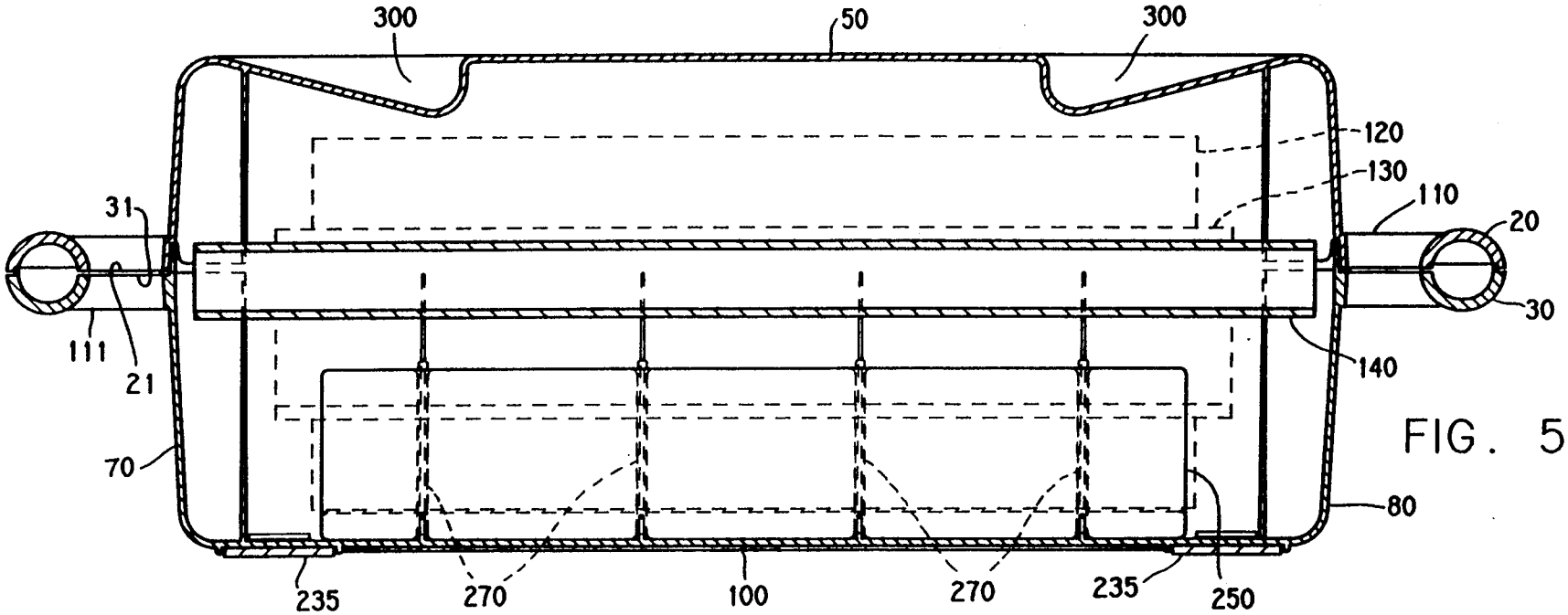
FIG. 5 is a cross section of the dispenser taken along section line 5—5 of FIG. 3.
Figure 6:
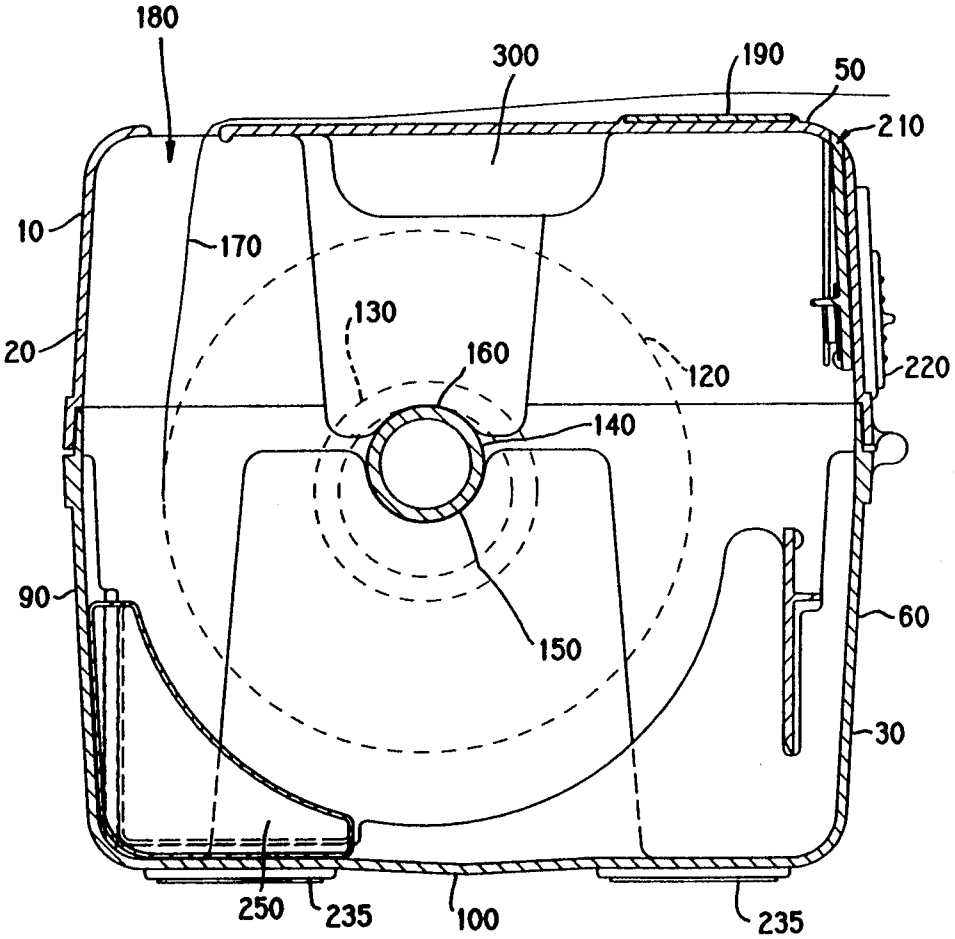
FIG. 6 is a cross section of the dispenser taken along section line 6—6 of FIG. 1.

Turning to FIGS. 5 and 6, the film roll 120 is first placed in lower portion 30. Film roll 120 is typically wrapped around a hollow roll form 130 which is placed loosely over axle 140. Axle 140 rests lengthwise in dispenser 10 and is held in retainer well 150 on each side 70, 80 of lower portion 30 of dispenser 10 and is firmly secured in place by retainer cap 160 on each side 70, 80 of upper portion 20 of dispenser 10 when the lower portion 30 and upper portion 20 are mated (closed) (see, e.g., FIG. 1). When the dispenser is open, film roll 120 may be replaced by removing axle 140 from the dispenser and film roll 120 from axle 140.

Figure 10:
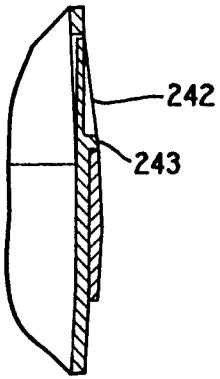
FIG. 10 is a cross section taken along section line 10—10 of FIG. 2 showing the snap fasteners which hold the upper and lower portions of the dispenser together.

Lower portion 30 and upper portion 20 are held closed by a pair of two-piece snap fasteners 241 located on front 60 of dispenser 10. Turning now to FIG. 10, the male portion 242 of snap fastener 241 engages and locks to a female portion 243. Release is effected by pressing both the male portions 242 back toward roll 120 while lifting up on upper portion 20. Simply closing the dispenser engages and locks snap fasteners 241.

Turning now to FIG. 6, film web 170 from roll 120 is threaded through lengthwise exit slot 180 in top 50 of roll film dispenser 10. Film web 170 continues out of exit slot 180 at the top rear of dispenser 10, over acrylic strip 190 (FIG. 6) and may be cut by serrated blade 200 which is shown extended for cutting in FIG. 7. Acrylic strip 190 is preferably relatively smooth and about 1.5 inches wide and about 1/16 inches thick. The length of the strip should conform to the width of the PVC film used. It is preferably attached to top 50 with glue or other well known adhesive means.

Acrylic strip 190 is preferably used in conjunction with dispensing PVC-type films. It has been discovered that PVC-type films exhibit a "static cling" or electrostatic attraction to acrylic materials such as that used in strip 190. Because of this attraction, by disposing a strip of acrylic 190 just before blade 200, the PVC film which does not "cling" to the ABS plastic of which dispenser 10 is preferably made, may be stabilized by "clinging" to acrylic strip 190 and unwanted tangling and folding of the film is thus largely prevented.

Indentations 300 shown in FIGS. 3, 5 and 6 are provided in top 50 to permit the user to easily grasp the film 170. The indentations are preferably wide enough to permit 3 or more human fingers to get below film 170 so that film 170 may be conveniently grasped. This width is preferably about 2 inches. The indentation is preferably about ½–¾ inches deep (from top 5) and 2–3" long (from sides 70,80).

Figure 7:
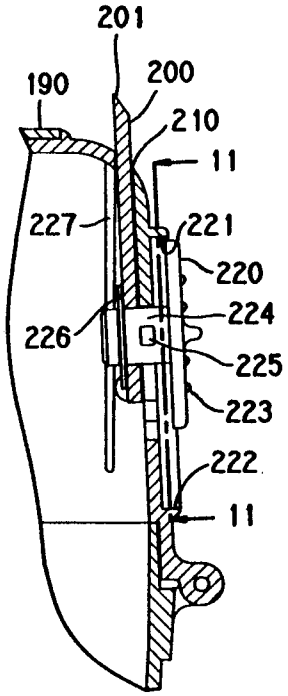
FIG. 7 is a cross-sectioned detail of the blade retractor mechanism taken along section line 7—7 of FIG. 1.

Serrated blade 200 is preferably formed of a polycarbonate plastic such as lexan and is retractable and user replaceable. FIG. 5 shows serrated blade 200 in the retracted position and FIGS. 1, 2 and 7 show it in the extended position. Serrated blade 200 travels through blade slot 210. Blade slot 210 is a lengthwise slot in top 50 adjacent front 60 of the dispenser. It is distinct from exit slot 180. In FIGS. 1, 12 and 13 serrated blade 200 is shown in detail. The cutting teeth are 3-sided and isosceles triangular in cross section. A flat side of the teeth faces the rear of the dispenser as shown in FIG. 13. The ends 280, 290 of blade 200 are rounded for safety and cutting edge 201 is oriented toward the rear of dispenser 10 as shown so that the possibility of accidental injury is minimized. Thus cutting edge 201 is adjacent rear face of blade 202. Additionally, no cutting teeth are located immediately adjacent blade edges 280, 290 as shown in FIG. 12 to help prevent accidental injury. In a preferred embodiment of the present invention, no teeth are located within about 13/16 inches of blade edges 280, 290.

An additional safety feature incorporated into a preferred embodiment of the present invention works as follows: when dispenser 10 is opened for maintenance or film roll replacement, blade 200 is not exposed to the person opening the dispenser, rather, because it is attached to upper portion 20, it folds over and faces down when dispenser 10 is open. In this way someone working with their hands on the inside of dispenser 10 is much less likely to cut themselves on blade 200 regardless of whether blade 200 is retracted or extended.

Figure 11:
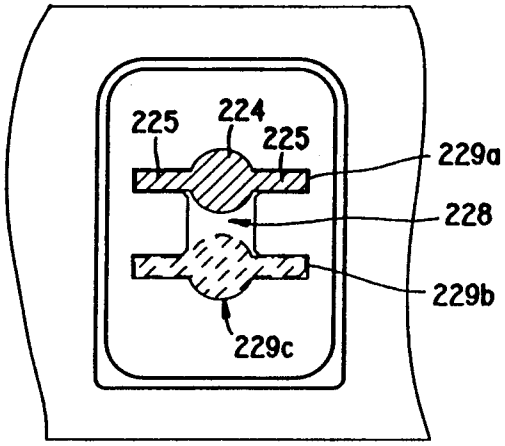
FIG. 11 is a cross section of the locking mechanism of the dispenser blade taken along section line 11—11 of FIG. 7.

Retractor controls 220 are hand-operated and switch selectable and control whether serrated blade is up (extended) or down (retracted). When retractor controls 220 are switched down and snapped into a first locked position, serrated blade 200 retracts. When they are switched up and snapped into a second locked position, serrated blade 200 is extended and available to cut the film. FIGS. 5, 7 and 11 detail the construction of retractor controls 220.

FIG. 5 depicts retractor control 220 in the blade-retracted position. FIG. 7 depicts retractor control 220 in the blade-extended position. There are two stops to limit the travel of retractor control 220: the upper stop 221 and the lower stop 222 are shown at FIG. 7. Retractor control 220 has a knurled front piece 223 and a single post 224 of circular cross section. Post 224 has a crossbar 225 and a back plate 226. The retractor control is biased into a first position outward from front 60 by flexible plastic member 227. When in the first position post 224 is not free to move in the vertical portion 229*c* of H-shaped slot 228. Post 224 and crossbar 225 are capable of vertical travel in portion 229*c* of sideways H-shaped slot 228 when pressure is applied to knurled front piece 223 so as to move it into a second position overcoming the bias imparted by flexible plastic member 227 (a lever spring) and moving it toward front 60. At rest in the retracted position blade 200 is retracted and crossbar 225 is engaged in lower portion 229*b* of sideways H-shaped slot 228. Pressing knurled front piece 223 disengages crossbar 225 from lower portion 229*b* and frees post 224 to move in vertical portion 229*c* of sideways H-shaped slot 228. Upward pressure on knurled front piece 223 will then cause post 224 to move upward in vertical portion 229*c* along with blade 200 whereupon pressure on knurled front piece 223 may be released when the end of travel is reached. At this point crossbar 225 will engage upper portion 229*a* of sideways H-shaped slot 228 and thus lock the blade in the extended position due to the bias imparted by member 227.

Figure 9:
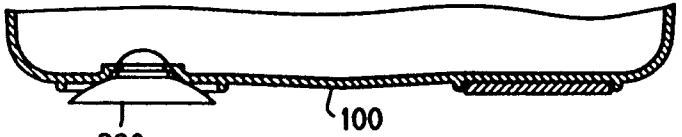
FIG. 9 is a cross section showing another alternative embodiment for the feet of the dispenser.
Figure 8:
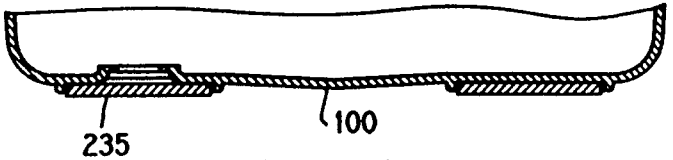
FIG. 8 is a cross section showing an alternative embodiment for the feet of the dispenser.

Optionally, non-skid suction-cup-type feet 230 as shown in FIG. 9 may be installed through holes in bottom 100 to reduce movement of the roll film dispenser 10 when in use. Alternatively, more conventional rubber, cork or other non-skid inserts 235 may be used as feet as shown in FIG. 8. Additional anti-skid and anti-rollover properties are achieved by offsetting axle 140 so that rather than being located at the geometric center of the dispenser, it is shifted toward the rear (away from the front). This counters the tendency of dispenser 10 to roll toward the person pulling on the flexible wrap by shifting the center of gravity toward the rear 90.

To further resist rollover, a weight 250 shaped to snap fit over support ribs 270 against the back and lower wall of dispenser 10 and circularly contoured at surface 260 to allow a full roll of film to rotate freely on axle 140 is provided. Weight 250 further counters the tendency of the dispenser to roll toward the person pulling on the flexible wrap by shifting the center of gravity of dispenser 10 down and toward the rear 90. Weight 250 can be fabricated of solid metal, other solid material, or more preferably of a plastic container which may be shipped at less cost to a customer empty then filled by the user with water, sand, or other material to increase its weight.

In a preferred embodiment of the present invention bottom 100 is fabricated with a reverse crown as shown in FIGS. 6, 8 and 9. Drain holes 310 (FIG. 4) are preferably located at the lowest part of the interior of dispenser 10 so that there will be no build-up of fluid within dispenser 10.

What is claimed is:

1. A roll film dispenser for dispensing and cutting material on a roll comprising:

a container body divided into an upper portion and a lower portion attached thereto with a hinge, said upper portion including a top, rear, front, two sides and lower rim, said lower portion including a bottom, rear, front, two sides and upper rim;

a first lengthwise slot in said top of said upper portion adjacent said front of said upper portion;

a switch retractable blade for cutting the material capable of being selectively placed in one of a first retracted position and a second extended position and having a cutting edge which extends through said first lengthwise slot when said blade is placed in said second extended position;

a knurled switch front piece attached to said blade with a post; and a crossbar attached to said post, a sideways "H" shaped slot fixed with respect to said container body and adapted to receive and lock said crossbar at upper and lower extremities of said sideways "H" shaped slot and to permit vertical movement of said post within said sideways "H" shaped slot when said crossbar is not locked thereto;

said switch, said post and said crossbar moveable in a direction normal to a plane defined by said front of said upper portion between an unlocked and a locked position and biased toward said locked position by a spring;

said switch, said post and said crossbar moveable between a first position corresponding to said first retracted position and a second position corresponding to said second extended position.

2. The apparatus of claim 1 wherein said hinge is attached to both said front of said upper portion and said front of said lower portion.

3. The apparatus of claim 1 further comprising a strip of acrylic material attached to said top of said upper portion adjacent to and rearward of said first lengthwise slot.

4. The apparatus of claim 3 wherein said top of said upper portion further includes a second lengthwise slot and adapted to pass the material from the interior of said container to the exterior thereof.

5. The apparatus of claim 4 further comprising a weight located at the juncture of said rear and said bottom of said lower portion and having a front surface conforming to the material on a roll.

6. The apparatus of claim 5 wherein said weight is a container capable of being filled with a fluid.

7. The apparatus of claim 6 further including a pair of indentations in said top rearward of said acrylic strip.

8. The apparatus of claim 4 further comprising a lengthwise axle and wherein said lower portion further comprises a pair of retainer wells within said container body adjacent each said side of said lower portion, said upper portion further comprises a retainer cap within said container body adjacent each said side of said upper portion, said retainer wells and said retainer caps adapted to grip and hold said axle at its lengthwise extremities.

9. The apparatus of claim 8 wherein the distance between said axle and said front of said lower portion is greater than the distance between said axle and said rear of said lower portion.

* * * * *